United States Patent [19]

Voland

[11] 4,382,689

[45] May 10, 1983

[54] CLUTCH FOR A TIMING MECHANISM

[75] Inventor: Elmo W. Voland, Indianapolis, Ind.

[73] Assignee: Emhart Industries, Inc., Indianapolis, Ind.

[21] Appl. No.: 205,608

[22] Filed: Nov. 10, 1980

Related U.S. Application Data

[63] Continuation of Ser. No. 9,125, Feb. 5, 1979, abandoned, which is a continuation-in-part of Ser. No. 932,701, Aug. 11, 1978, abandoned.

[51] Int. Cl.[3] ..... G04B 19/00; G04F 1/00

[52] U.S. Cl. ..... 368/76; 368/108; 368/191

[58] Field of Search ..... 368/31, 32, 76, 69, 368/97–100, 101, 106, 107–113, 184, 185, 190–192, 220, 224, 225, 308, 319; 200/35 R–38 BA

[56] References Cited

U.S. PATENT DOCUMENTS

| | | | |
|---|---|---|---|
| 2,869,639 | 1/1959 | Ambrolaitis | 368/106 |
| 3,742,159 | 6/1973 | Brown | 200/38 R |
| 3,785,141 | 1/1974 | Ikegami | 368/21 |
| 3,815,353 | 6/1974 | Wuthrich et al. | 368/191 |
| 3,895,485 | 7/1975 | Gerber et al. | 368/154 |

*Primary Examiner*—Vit W. Miska

*Attorney, Agent, or Firm*—R. F. Meyer; D. W. Gomes

[57] ABSTRACT

A clutch permits rotation of a cam means from one drive means independent of another. The clutch is operable through at least two diametrically opposed fingers engaging slots which are provided on a gear, the gear being part of a gear train for the motor drive means.

2 Claims, 3 Drawing Figures

CLUTCH FOR A TIMING MECHANISM

BACKGROUND OF THE INVENTION

This is a continuation of Ser. No. 9,125 filed Feb. 5, 1979, which is a continuation-in-part of application Ser. No. 932,701 filed Aug. 11, 1978, both now abandoned.

Generally speaking, the present invention relates to an improvement in a timing mechanism wherein a cam means is independently rotated by separate drive means and wherein at least one of the drive means is connected to the cam means by a gear train, the improvement comprising a clutch means permitting rotation of a cam means from one of the drive means independent of the other, the clutch including a hub rotatably carried on a shaft, a gear of the gear train carried by the hub, a plurality of slots disposed about a periphery of the gear, and a leaf spring fixedly carried on the hub, the leaf spring including at least two diametrically opposed fingers engaging the slots.

Timing mechanism are widely used in appliances such as dishwashers, washers and dryers to provide sequential operation of the functional elements of the appliances. In some appliances, for example clothes washers, there are many programs to be carried out by the timing mechanism. In some cases the operator of the appliance may not wish to use all of the programs available. In such cases, the timing mechanism is usually provided with two separate drive means such that the timing means can be driven at a fast rate past those programs which are not desired. Thus, there are timing mechanisms which employ two motor drive means which independently drive the timing mechanism. In such cases, a clutch means needs to be provided so that one drive means may be operated independent of the other.

OBJECTS OR FEATURES OF THE INVENTION

The present invention, therefore, is concerned with an improved clutch for a timing mechanism and has as one of its features the provision of a clutch which provides for separate drive means to be operated independently. Another feature of the invention is a provision of the clutch for a timing mechanism utilizes a leaf spring engaging a plurality of slots disposed about a periphery of a face of a gear of a gear train. Another feature of the invention is the provision of such a clutch wherein the gear is carried by a hub which is rotatably carried on a shaft. Another feature of the invention is the provision of such a clutch wherein the leaf spring includes at least two diametrically opposed fingers engaging the slots. Still another feature of the invention is the provision of such a clutch wherein there are bent-over tabs disposed at distal ends of the fingers. Yet another feature of the invention is the provision of such a clutch wherein the fingers form an S-shaped spring. These and other features of the invention will become apparent from the following description taken in conjunction with the accompanying drawings.

DETAILED DESCRIPTION OF THE INVENTION

Figure 1:
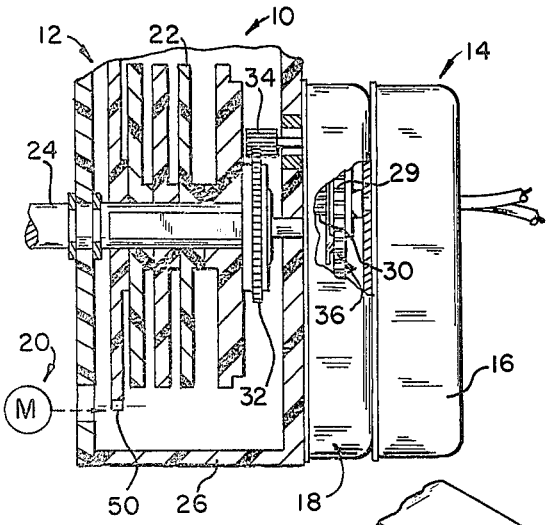
FIG. 1 is a cross section taken in elevation of a timing mechanism employing the invention.

Referring now to the drawings, there is shown a timing mechanism 10 which in general includes a cam means 12 and a power drive means 14 which includes a motor 16 and a gear train 18. In the particular embodiment shown, there is also a second power drive means 20 which includes a motor and gear train similar to that of motor 16 and gear train 18. As will be described hereinafter, the power drive means 20 can be used to rapidly advance the cam means 12 to skip portions of the over-all program cycle.

Figure 2:
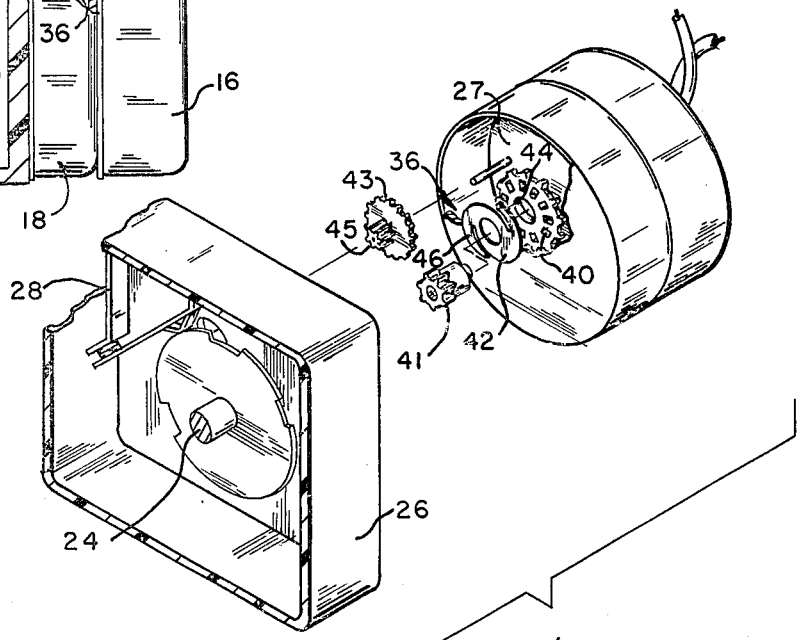
FIG. 2 is an exploded view of a portion of the timing mechanism

Cam means 12 includes a plurality of cams 22 which are fixedly carried on a shaft 24, the shaft being rotatably journalled in timer housing26. The cam means 12 opens and closes a plurality of electrical switches one of which 28 is shown in FIG. 2. Gear train 18 includes a series of gears 29 and pinions 30 connecting motor 16 to a drive gear 32 through output pinion 34. Also included as part of the gear train is a clutch means 36 which permits the power drive means 14 and 20 to independently drive cam means 12.

Figure 3:
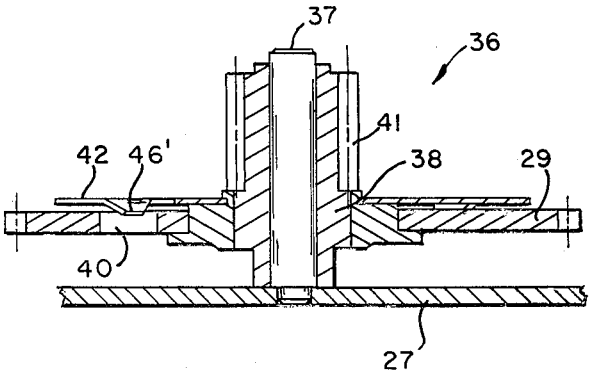
FIG. 3 is a cross section of the clutch of the invention.

Referring particularly to FIGS. 2 and 3, clutch means 36 includes a hub 38 rotatably carried on a shaft 37, gear 29 of the gear train 18, the gear being free to rotate about the hub and having a plurality of slots 40 disposed about a periphery of the gear, and a leaf spring 42 fixedly carried on the hub. Shaft 37 is fixedly carried in base 27 of a housing for the gear train and housing 26 of the timing mechanism. As shown, the leaf spring includes at least two diametrically opposed fingers 44 and 46 the fingers forming an S-shaped spring. Each of the fingers include bent-over tabs 46' disposed at their distal ends and engaging the slots. Hub 38 includes a pinion 41 which engages a gear 43 of a combination gear and pinion 45 of the gear train.

As noted previously, clutch means 36 permits the two power drive means 14 and 20 to operate independently of each other. The clutch may also be used to provide manual rotation of shaft 24 independent of the power drive means in the event second motor drive means is not used or if the second drive means is needed, another similar clutch could be incorporated into the system. In operation, when motor drive means 14 drives gear 29 in a predetermined direction, tabs 46 will remain engaged with slots 40 to drive cam means 12 through the gear train, output pinion 34 and drive gear 32. Power drive means 20 will, when energized, rotate shaft 24 in the same direction through gear 50 at a faster rate. Rotation of shaft 24 at the faster rate will cause tabs 46 to become disengaged from the slots 40 to permit gear 29 to remain stationary, thus permitting the motor drive means 20 to over-ride power drive means 14.

What is claimed is:

1. In a timing mechanism wherein a cam means is independently rotated by two separate motor drive means in a predetermined direction and wherein at least one of said motor drive means is connected to said cam means by a gear train, the improvement characterized by a clutch means permitting rotation of said cam means by one of said motor drive means independent of the other, comprising:

(a) a hub rotatably carried on a shaft, (b) a gear of said gear train rotatably carried by said hub, (c) a plurality of slots disposed about a periphery of a face of said gear, (d) a leaf spring fixedly carried on said hub, said leaf spring including at least two diametrically opposed fingers pointed in said predetermined direction, and (e) a bent-over portion extending from a distal end of said fingers in the same direction toward which said fingers are pointing so as to engage said slots and drive said gear in said predetermined direction.

2. In a timing mechanism according to claim 1 wherein said slots are spaced about the entire surface of said periphery.

* * * * *